United States Patent [19]

Marty

[11] 3,965,940

[45] June 29, 1976

[54] RIGID AND FLEXIBLE MOUNTING FOR REED-DENT IN A PROFILED STAVE

[76] Inventor: Emil Marty, 38 Plattenstrasse, 8810 Horgen, Switzerland

[22] Filed: Mar. 5, 1975

[21] Appl. No.: 555,748

[30] Foreign Application Priority Data

Mar. 6, 1974 Switzerland ..... 3181/74

[52] U.S. Cl. ..... 139/192

[51] Int. Cl.[2] ..... D03D 49/62

[58] Field of Search ..... 139/192, 48; 28/54

[56] References Cited

UNITED STATES PATENTS

| | | | |
|---|---|---|---|
| 2,572,365 | 10/1951 | McFetters | 139/192 |
| 2,783,780 | 3/1957 | Wagner | 139/192 |
| 2,989,088 | 6/1961 | Schmidt | 139/192 |
| 3,189,056 | 6/1965 | Parks | 139/192 |

FOREIGN PATENTS OR APPLICATIONS

| | | | |
|---|---|---|---|
| 1,505,142 | 10/1967 | France | 139/192 |
| 1,146,831 | 5/1957 | France | 139/192 |
| 614,713 | 1/1961 | Italy | 139/192 |
| 842,486 | 7/1960 | United Kingdom | 139/192 |

*Primary Examiner*—James Kee Chi

*Attorney, Agent, or Firm*—Sughrue, Rothwell, Mion, Zinn & Macpeak

[57] ABSTRACT

A reed-dent (1) extending into the opening of a profiled stave (2) is held in place by a rigid bonding agent (3) in the bottom of the opening and a flexible bonding agent (4) at the exit of the opening.

6 Claims, 7 Drawing Figures

2
9
1
II
II 2
1
I
I 2
2
1

1
2
3
4
5
6
7
8
9
11
12

RIGID AND FLEXIBLE MOUNTING FOR REED-DENT IN A PROFILED STAVE

BACKGROUND OF THE INVENTION

1. Field of the Invention

This invention relates to a textile weaving machine reed with reed-dents which are connected at both ends to a profiled stave.

2. Description of the Prior Art

A textile machine reed fixed at one or both ends to profiled staves in a sley is exceedingly stressed during weft beat-up. Especially with fabrics requiring a hard beat-up, very great forces have to be transmitted between the reed-dents, profiled staves and sley, which makes excessive demands on the connection between reed-dents and profiled staves. This connection should be rigid and have a high strength. On weaving machines, vibrations often occur leading to breakages of reed-dents or destruction of the usual connection between reed-dents and profiled staves. Therefore, it is appropriate to anchor the reed-dents flexibly in the profiled stave. This offers the further advantage that knots or thick places in the warp yarn can more easily be pulled between the reed-dents without deforming them permanently or even breaking them. A disadvantage of the usual flexible connection is, however, its inferior strength.

SUMMARY OF THE INVENTION

It is an object of this invention to anchor reed-dents in profiled staves in such a way that the requirements for strength as well as for the flexibility of the connection will be met.

In conformity with the invention, this requirement is met in that the ends of reed-dents project into an opening of the profiled stave and are embedded in both a rigid and a flexible connecting agent. Appropriately, the rigid connecting agent can be in the base of the opening and the flexible agent can fill the remaining free portion of the opening and can cover the reed-dents until they leave the opening.

DESCRIPTION OF THE PREFERRED EMBODIMENTS

Figure 2:
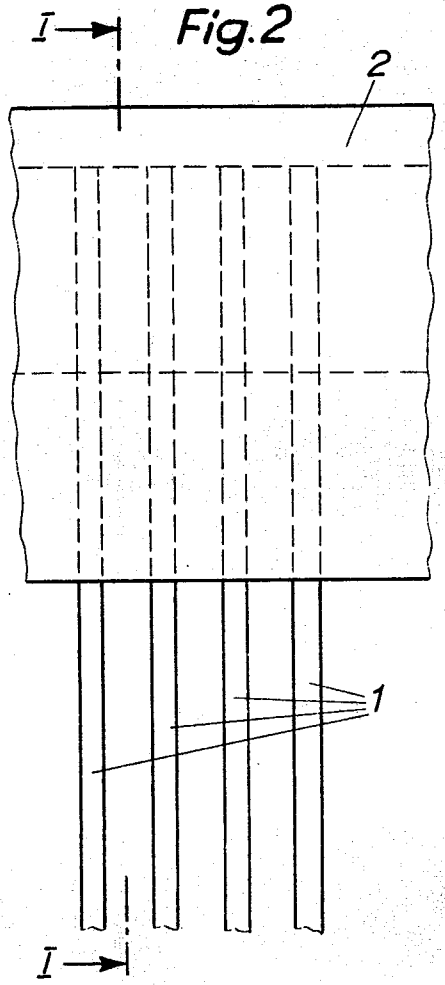
FIG. 2 shows a section of FIG. 1 on enlarged scale.
Figure 1:
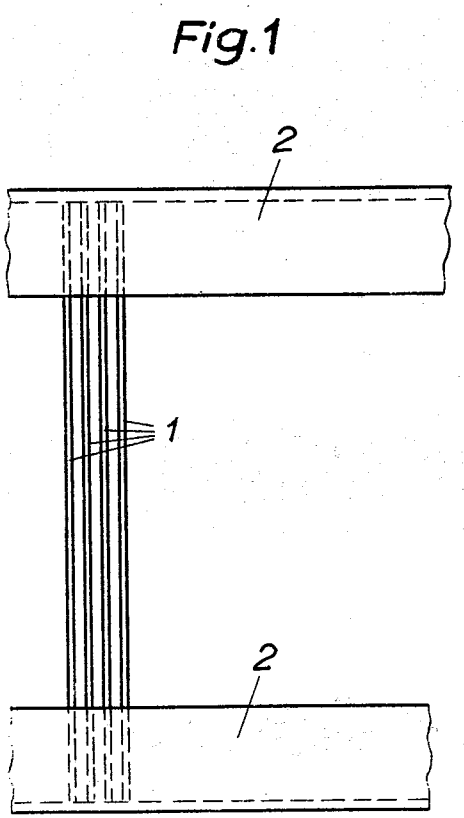
FIG. 1 shows a view of a cut of a reed.

FIG. 1 shows a section of a reed with two profiled staves 2 and reed-dents 1 which are anchored therein. FIG. 2 shows a cut of the reed on an enlarged scale in the region of the anchorage. From the cross-section I—I (FIG. 3) it can be seen that the end of the reed-dent 1 projects into a U-shaped opening of the profiled stave 2 and at the base of the opening it is rigidly, wear-resisting and non-detachably connected with the profiled stave 2 by means of a rigid cementing agent 3. The rigid agent 3 may be, for instance, a hard synthetic material, a soldering agent or a Duroplast bonding agent. By this means forces can be reliably transmitted on the profiled staves 2 fixed in the sley and on the reed-dents 1 and vice versa. In order to avoid a break-off of the reed-dents at the place where they enter this rigid connecting agent, a second, flexible connecting agent 4 is provided. It may be a flexible synthetic material, a vulcanized rubber or a flexible bonding agent. The flexible connecting agent 4 joins on the rigid connecting agent 3, fills the remaining space in the opening and embeds the reed-dents 1 up to their exit from the opening.

In order to increase the flexibility of the anchorage of the reed-dents 1, the opening, in the region of the flexible connecting agent 4, can be larger than in the region of the rigid connecting agent 3.

It is of advantage if the mouth of the opening is widened towards the outside by providing the shanks 12 with a tapering 11 so that the reed-dents 1 in the region of the flexible connecting agent 4 can perform small flexible movements in relation to the profiled stave 2 as the function of the reed requires it.

Figures 3, 4, 5, 7:
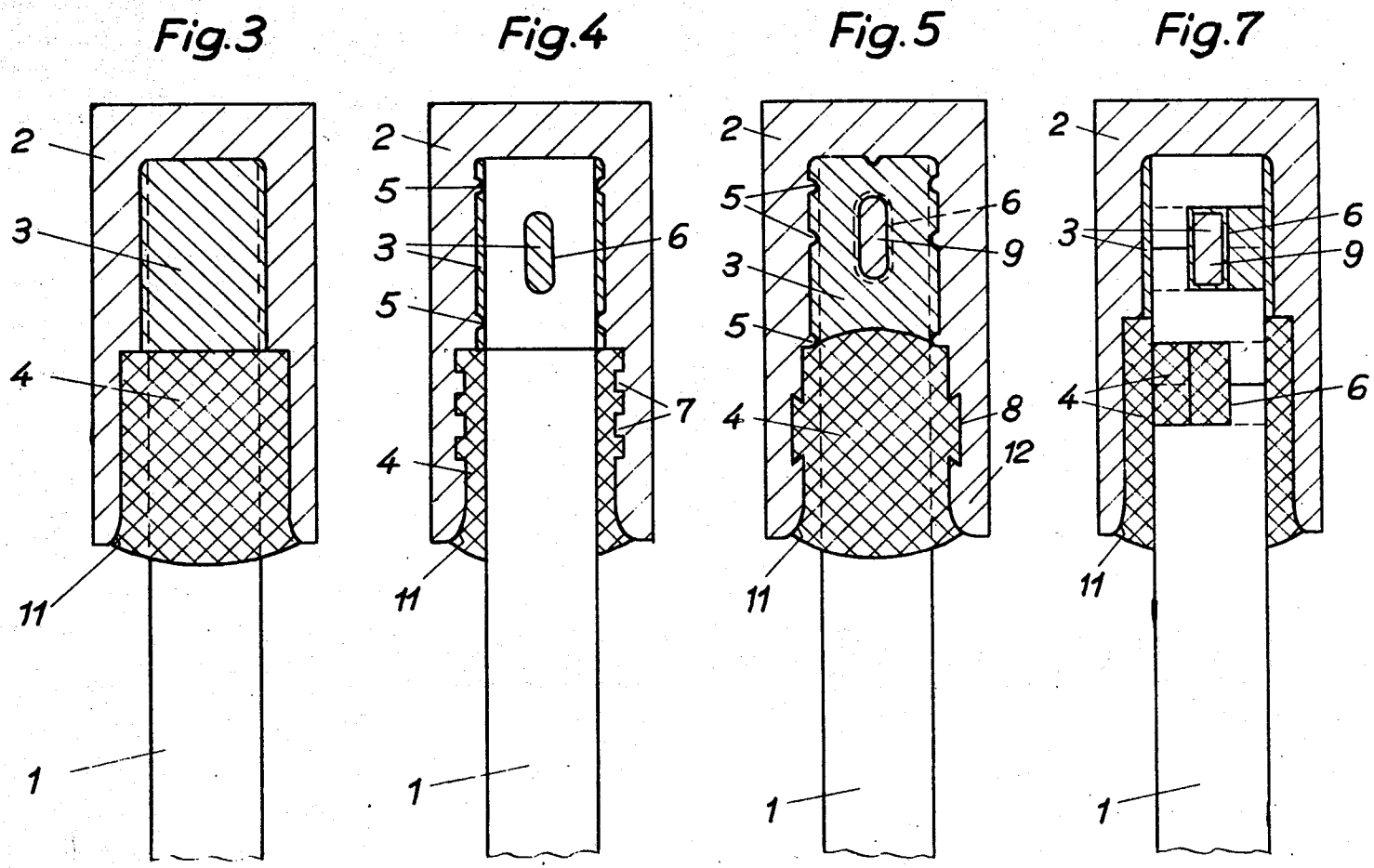
FIG. 3 shows the cross-section I—I of FIG. 2.
FIG. 4 shows a cross-section of a second embodiment.
FIG. 5 shows a cross-section of a third embodiment.
FIG. 7 shows the cross-section II—II of FIG. 6.

In the embodiment shown in FIG. 4 the inside walls of the opening in the region of the rigid connecting agent 3 are provided with ribs 5 in order to facilitate the centering of the reed-dents 1 in the profiled stave 2. Additional ribs 7 in the region of the flexible connecting agent 4 improve the adhesion of the flexible connecting agent in the profiled stave. The ribs 5 further help to maintain a distance for the rigid connecting agent 3 between the reed-dent and the wall of the opening. The anchorage of the reed-dent 1 in the profiled stave is improved by placing at least one slot 6 at the end of the reed-dent.

As shown in FIG. 5 the slots 6 may accommodate a rod 9 which will additionally help to improve the anchorage. Further, by providing dovetail grooves 8, the shanks 12 of the profiled stave 2 will be held together, i.e. prevented from unduly spreading, by means of the flexible connecting agent 4.

Figure 6:
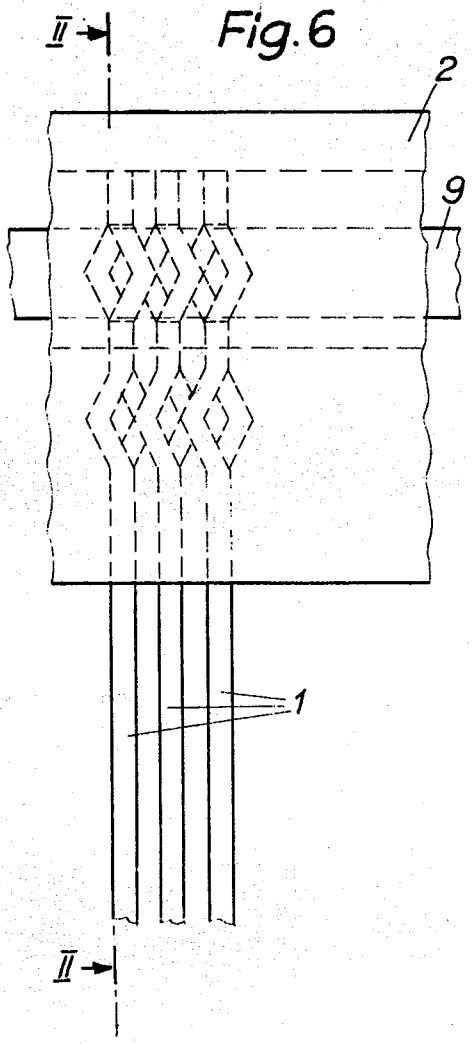
FIG. 6 shows a partial view of a fourth embodiment.

In a further embodiment shown in FIG. 6, the reed-dents 1 are provided with two longitudinally arranged slit like openings at either end. As shown in FIG. 7, these openings may be identical with the slots 6 for accommodating a rod 9.

The requirements for strength and flexibility may be fulfilled by using an Epoxyd-2 component bonding agent as the rigid connecting agent 3 and a Polyurethane bonding agent as the flexible connecting agent 4.

Accurate spacing between the reed-dents may be achieved in the usual manner by means of inserting a coil spring between the dents. The spring can be soldered-in or be removed after the soldering process.

In a further embodiment, not shown, there is a gradual transition between the connecting agents 3, 4 in which the flexible agent 4 and rigid agent 3 gradually merge with each other.

What is claimed is:

1. In a textile weaving machine an improved reed-dent mounting arrangement comprising:

a. a plurality of reed-dents (1);

b. at least one stave (2) having a U-shaped cross-section to engage an end of the reed-dents;

c. a rigid bonding agent (3) surrounding the end of the reed-dent inserted into the stave so as to rigidly bond said reed-dent to said stave; and d. a flexible bonding agent (4) surrounding the end of the reed-dent adjacent said rigid bonding agent so as to flexibly attach said reed-dent to said stave.

2. A mounting arrangement according to claim 1, characterized in that the rigid bonding agent (3) is located adjacent the base of the U-shaped cross section and the flexible bonding agent (4) is in the remaining space closer to the opening, embedding the reed-dent up to its exit from the stave.

3. A mounting arrangement according to claim 1, characterized in that the width of the U-shaped cross-section of the stave is narrower in the region of the rigid bonding agent than in the region of the flexible bonding agent, and that the shanks (12) of the stave are tapered (11) enabling the reed-dent to make small flexible movements in relation to the stave.

4. A mounting arrangement according to claim 1, characterized in that the inner surfaces of the U-shaped cross-section are provided with ribs (5, 7) to facilitate the centering of the reed-dents in the stave.

5. A mounting arrangement according to claim 1, characterized in that the end of reed-dent is provided with at least one longitudinal slot-like opening therethrough, both sides of which are offset and bent out in opposite directions.

6. A mounting arrangement according to claim 1, characterized in that the rigid bonding agent and the flexible bonding agent gradually merge into each other.

* * * * *